United States Patent [19]

Pagliaro

[11] Patent Number: 4,682,527

[45] Date of Patent: Jul. 28, 1987

[54] PEG DROPS

[76] Inventor: Michael J. Pagliaro, 219 Sprain Rd., Scarsdale, N.Y. 10583

[21] Appl. No.: 940,104

[22] Filed: Dec. 10, 1986

[51] Int. Cl.[4] ..... G10G 7/00

[52] U.S. Cl. ..... 84/305; 84/452 R; 84/453

[58] Field of Search ..... 84/274, 304, 305, 452 R, 84/453

[56] References Cited

U.S. PATENT DOCUMENTS 767,499 8/1904 Pierce ..... 84/452 R X

*Primary Examiner*—Lawrence R. Franklin

*Attorney, Agent, or Firm*—Lilling & Greenspan

[57] ABSTRACT

The mixture includes between 300 and 600 ml. of isopropyl alcohol, 100 to 199 ml. of tincture of green soap, 100 to 199 ml. of glycerin and between 21 and 43 grams of violin rosin. These ingredients are mixed until an amalgamated and homogeneous solution is obtained.

4 Claims, No Drawings

PEG DROPS

This invention corresponds to the disclosure document No. 152589, filed July 2, 1986, in the U.S. Patent and Trademark Office, and the complete disclosure of that disclosure document is hereby incorporated herein by reference.

BACKGROUND OF THE INVENTION

One of the problems inherent to stringed musical instruments is that the pegs holding the strings have a tendency to slip or to creak. When the peg slips, this causes the string to lose tension and changes the pitch of the instrument.

The peg drops of this invention are designed to prevent slippage of the pegs of a musical instrument and to also prevent creaking.

SUMMARY OF THE INVENTION

The peg drops of this invention, in the preferred environment, consist of 500 ml. of alcohol, 166 ml. of tincture of green soap, 166 ml. of glycerin and 36 g. of violin rosin. These ingredients are mixed into a homogeneous solution and then applied to the pegs of the musical instrument. This will prevent creaking and will also prevent slippage of the pegs of the musical instrument.

DETAILED DESCRIPTION OF THE INVENTION

The peg drops of this invention consists of a homogeneous mixture of isopropyl alcohol, tincture of green soap, glycerin and violin rosin. It is also possible to use condensed turpentine instead of the violin rosin.

The mixture would typically include between 300 and 600 ml. of isopropyl alcohol, 100–199 ml. of tincture of green soap, 100–199 ml. of glycerin and between 21 and 43 g. of the violin rosin. In the preferred embodiment, there would be 500 ml. of isopropyl alcohol, 166 ml. of tincture of green soap, 166 ml. of glycerin, and 36 g. of violin rosin. If the violin rosin is measured by ml., instead of grams, another preferred embodiment of the mixture would include 300 ml. of isopropyl alcohol, 100 ml. of tincture of green soap, 100 ml. of glycerin and 21.6 g. of violin rosin. If the above proportions are not adhered to, the peg drops will not work properly, and the peg may still slip or even stick. Thus, it is necessary to keep the mixture within the above-mentioned proportions.

In order to make the peg drops, the violin rosin is crushed into powder and blended into the isopropyl alcohol until it is completely dissolved. This can be done with a conventional mixing device and should be done at room temperature. This will result in an amalgamated or homogeneous mixture.

Then, while the amalgamated mixture of isopropyl alcohol and violin rosin is still being mixed, the glycerin is added until the mixture is completely amalgamated and homogeneous with the three elements. Thereafter, while the mixture is still being mixed, the tincture of green soap is added until a new amalgamated and homogeneous mixture is obtained.

After the mixture is made, it stays homogeneous and no heating or cooling is required.

For best results, there should be the same amount of tincture of green soap and glycerin and there should be approximately three times as much isopropyl alcohol as there is either tincture of green soap or glycerin. In other words, the ratio of the tincture of green soap, glycerin and isopropyl alcohol should be 1:1:3.

In order to apply the peg drops to a musical instrument, the peg should be loosened and partially removed from the peg box, but the peg should not be completely removed. One drop of the peg drop would then be applied to each peg at the point at which it contacts the peg box. The peg would then be reinserted into the peg box, and the excess liquid should be wiped off.

The instrument can be used immediately after the peg drops are applied, but it will typically take about twelve (12) hours for the peg drops to obtain optimum results. It will take this amount of time for the peg drops to seep into the wood in order to prevent slippage and to eliminate creaking.

The peg drops of this invention will thus provide a means for eliminating slippage of the pegs of a musical instrument and will also prevent creaking. It may be used on any stringed musical instrument, such as violins, cellos, violas, etc.

I claim:

1. Peg drops for stringed musical instruments comprising 300–600 ml. of isopropyl alcohol, 100–199 ml. of tincture of green soap, 100–199 ml. of glycerin and between 21 and 43 g. of violin rosin.

2. Peg drops according to claim 1, wherein there are 500 ml. of isopropyl alcohol, 166 ml. of tincture of green soap, 166 ml. of glycerin and 36 g. of violin rosin.

3. Peg drops according to claim 1, wherein the proportion of tincture of green soap to glycerin to isopropyl alcohol is 1:1:3.

4. A method of making peg drops for stringed musical instruments comprising the steps of: crushing the violin rosin into powder; blending the crushed violin rosin into the isopropyl alcohol until an amalgamated and homogeneous mixture is obtained; adding the glycerin to the amalgamated and homogeneous mixture of violin rosin and isopropyl alcohol until the glycerin is completely amalgamated; and mixing the green soap into the amalgamated and homogeneous mixture of violin rosin, isopropyl alcohol and glycerin until an amalgamated and homogeneous mixture of violin rosin, isopropyl alcohol, glycerin and tincture of green soap is obtained.

* * * * *